US006915577B2

(12) United States Patent
Scala

(10) Patent No.: US 6,915,577 B2
(45) Date of Patent: Jul. 12, 2005

(54) UTILITY KNIFE BLADE SECURING DEVICE

(76) Inventor: Robert Scala, 7498 E. Monte Cristo Ave., Scottsdale, AZ (US) 85260

( * ) Notice: Subject to any disclaimer, the term of this patent is extended or adjusted under 35 U.S.C. 154(b) by 24 days.

(21) Appl. No.: 10/360,243

(22) Filed: Feb. 7, 2003

(65) Prior Publication Data

US 2003/0150116 A1 Aug. 14, 2003

Related U.S. Application Data

(63) Continuation of application No. 10/053,719, filed on Jan. 22, 2002, now Pat. No. 6,688,003, which is a continuation-in-part of application No. 09/676,132, filed on Sep. 29, 2000, now Pat. No. 6,354,007.

(51) Int. Cl.[7] ..... B26B 1/02
(52) U.S. Cl. ..... 30/156; 30/330; 30/161
(58) Field of Search ..... 30/153, 155, 156, 30/157, 158, 159, 160, 161, 329, 330, 339, 344, 258, 260

(56) References Cited

U.S. PATENT DOCUMENTS

| | | | |
|---|---|---|---|
| 493,075 | A | 3/1893 | Evertz |
| 515,045 | A | 2/1894 | Von Bultzingslowen |
| 1,444,324 | A | 2/1923 | Brooks |
| 1,706,251 | A | 3/1929 | Perry |
| 2,134,973 | A | 11/1938 | Harwell |
| 2,265,775 | A | 12/1941 | McNamara |
| 2,284,128 | A | 5/1942 | Bush |

(Continued)

FOREIGN PATENT DOCUMENTS

GB 2 190 321 A * 11/1987

OTHER PUBLICATIONS

Great Neck Sheffield "Folding Lock–Back Utility Knife" dated year 2000, retrieved from web site: www.greatneck-saw.com/products/prod_detail.asp?method=sku&sku=12113&x=18&y=11.*

Copy of Mar. 27, 2004 letter from George T. Brinkley of Marble's Outdoor To Whom it May Concern.

Various pictures of the knife as compared to patent which is the subject of litigation (8).

Various clearer pictures of knife (8).

Copy of Mar. 19, 2004 letter from R.B. Jenkins to The B&F System, Inc.

Pictures of Kimball knife (5).

*Primary Examiner*—Hwei-Siu Payer
(74) *Attorney, Agent, or Firm*—Snell & Wilmer L.L.P.

(57) ABSTRACT

A utility knife include a handle, a neck pivotally mounted on the handle, and a blade mounted in the neck. The neck can be folded into the handle to transport the utility knife. The blade is slidably removably inserted into and out of the handle without requiring disassembly of the handle. The blade is secured to the neck of the knife by a pivotally mounted arm.

8 Claims, 9 Drawing Sheets

U.S. PATENT DOCUMENTS

| | | | | | |
|---|---|---|---|---|---|
| 2,479,788 | A | * | 8/1949 | Stokes | 30/330 |
| 2,523,575 | A | | 9/1950 | Kassel | |
| 2,914,850 | A | | 12/1959 | Kuhnl | |
| 2,980,996 | A | | 4/1961 | Beran | |
| 3,306,297 | A | | 2/1967 | Voorhees et al. | |
| 3,845,554 | A | | 11/1974 | Joanis et al. | |
| 4,017,969 | A | | 4/1977 | Stonebraker | |
| 4,261,104 | A | | 4/1981 | Cuscovitch | |
| 4,347,665 | A | | 9/1982 | Glesser | |
| 4,408,396 | A | | 10/1983 | Scholl | |
| 4,575,940 | A | | 3/1986 | Wenzel | |
| 4,604,805 | A | | 8/1986 | Krieger | |
| 4,620,369 | A | | 11/1986 | Grecken | |
| 4,936,014 | A | | 6/1990 | Shaanan et al. | |
| 5,095,624 | A | | 3/1992 | Ennis | |
| 5,303,469 | A | | 4/1994 | Yin-Han | |
| 5,404,646 | A | * | 4/1995 | Naifeh | 30/163 |
| 5,769,094 | A | | 6/1998 | Jenkins, Jr. et al. | |
| 5,909,930 | A | | 6/1999 | Ragland, III et al. | |
| 5,966,816 | A | | 10/1999 | Roberson | |
| 6,026,575 | A | | 2/2000 | Wonderley | |
| 6,263,581 | B1 | * | 7/2001 | Forte | 30/332 |
| 6,354,007 | B1 | * | 3/2002 | Scarla | 30/156 |
| 6,574,868 | B1 | * | 6/2003 | Overholt | 30/155 |
| 6,688,003 | B2 | * | 2/2004 | Scarla | 30/156 |
| D495,939 | S | | 9/2004 | Ping | |
| 2004/0107580 | A1 | * | 6/2004 | Ping | 30/160 |

* cited by examiner

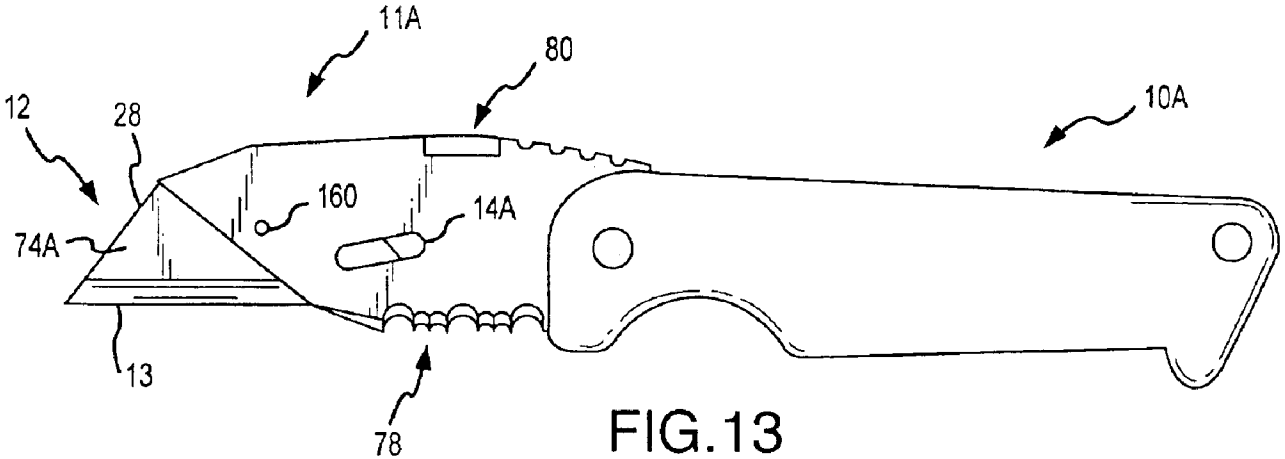
FIG.13
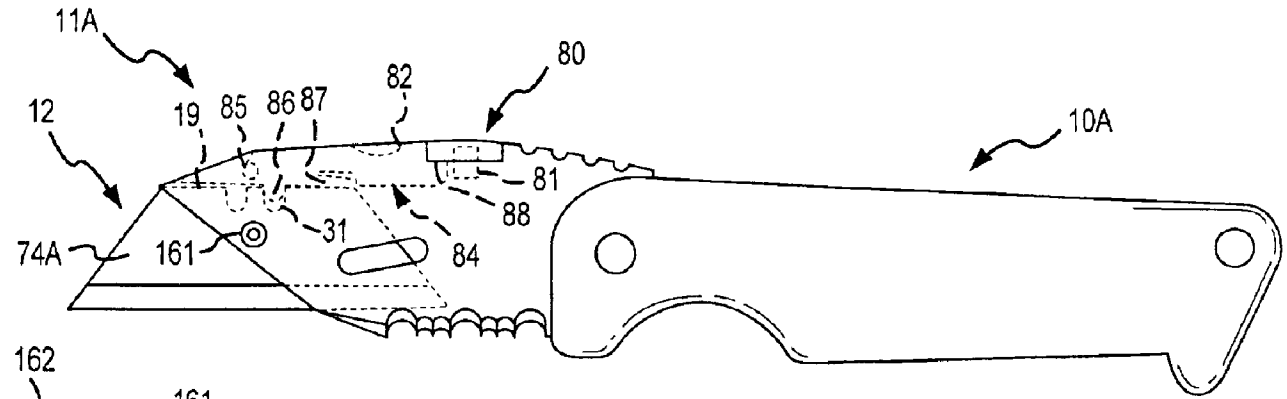
FIG.14
FIG.14A

UTILITY KNIFE BLADE SECURING DEVICE

CROSS REFERENCE TO RELATED APPLICATIONS

This application is a continuation in part of, and claims priority to, U.S. Ser. No. 10/053,719, filed on Jan. 22, 2002 and entitled "UTILITY KNIFE", now U.S. Pat. No. 6,688,003 issued on Feb. 10, 2004, which is a continuation in part of U.S. Ser. No. 09/676,132, filed Sep. 29, 2000, now U.S. Pat. No. 6,354,007 issued on Mar. 12, 2002.

FIELD OF INVENTION

This invention generally pertains to a utility knife. More particularly, this invention pertains to a utility knife which utilizes a cutting blade having a trapezoidal shape. In a further respect, this invention pertains to a system and method for securing a blade in the utility knife of the present invention.

BACKGROUND OF THE INVENTION

Conventional utility knives are well known and typically include an elongated handle which is approximately six inches long. A blade is usually mounted in the knife handle and the blade often has a trapezoidal shape. To mount a new blade into the handle, the blade is typically pushed through a slot formed in the front of the handle or the entire handle is dis-assembled with various tools in order to access the blade holding mechanism. In standard operation, the blade usually moves between a first stored operative position inside the handle and a second deployed operative position with a portion of the blade outside the handle. To move the blade into an operative position, a button on the knife handle (e.g., on the side or top of the knife) is slidably pushed along a slot formed in the handle. When the button is pushed to one end of the slot, the trapezoidal blade is in the first stored operative position. When the button is pushed to the other end of the slot, the trapezoidal blade is in the second deployed operative position. When the blade is in the second deployed operative position, the utility knife can be used to cut desired objects with the blade.

One disadvantage of a conventional utility knife is that, with use over time, the button becomes loose and the blade can unintentionally slide from its first stored operative position to its second deployed operative position. This can be dangerous when the user wishes to keep the blade in a secured position, especially when the utility knife is in a person's pocket or in the reach of children. Another disadvantage of a conventional utility knife is that the length of the handle makes is awkward to carry the knife in a clothing pocket. A further disadvantage of a conventional utility knife is that the entire handle of the knife ordinarily must be disassembled in order to insert a new blade in the utility knife.

Accordingly, it would be highly desirable to provide an improved utility knife and method for using the same which would facilitate the safe transport and use of the knife. A further object of the invention is to provide an improved apparatus and method for using a utility knife which includes a blade having a trapezoidal shape. Another object of the invention is to provide an improved method and apparatus for securing and removing a trapezoidal blade from a utility knife. Still a further object of the invention is to provide an improved method and apparatus for utilizing a utility knife which significantly reduces the risk that the utility knife blade can inadvertently slide free and injure a user. Another object of the invention is to provide a utility knife with an improved system and method for securing the blade within the blade holder.

BRIEF DESCRIPTION OF THE DRAWINGS

The foregoing and other, further and more specific objects and advantages of the invention will be apparent from the following detailed description of the invention, taken in conjunction with the drawings, wherein like numerals represent like elements, and:

FIG. 13 is a side elevation view illustrating a utility knife with an exemplary neck constructed in accordance with another embodiment of the invention;

FIG. 14 is a side elevation view illustrating further exemplary construction details of the knife of FIG. 13;

FIG. 14A is a perspective view illustrating an exemplary set screw used to secure a blade in the neck of the utility knife of FIG. 14;

DETAILED DESCRIPTION

Figure 1:
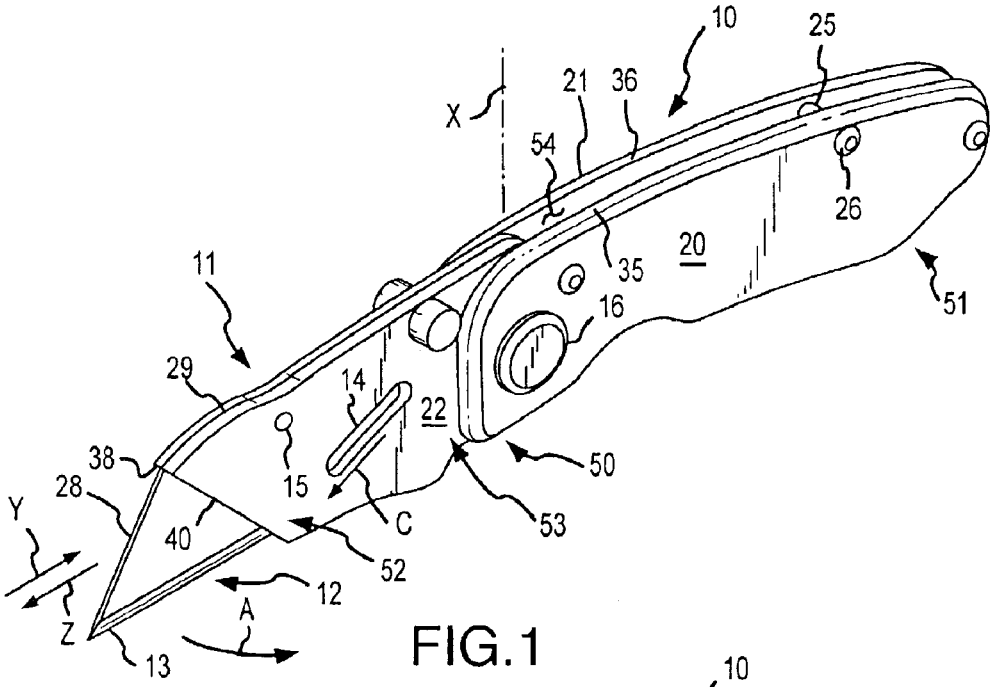
FIG. 1 is a perspective view illustrating an exemplary utility knife constructed in accordance with the principles of the invention.

In general, the utility knife includes a handle having a first end, a second end, and an elongate groove; a neck having a distal end and having a proximate end; and, a trapezoidal blade mounted on the distal end. The blade includes a base; an upper edge opposed to and spaced apart from the base; a cutting edge extending along the base; and, an anchor opening formed through the blade. About half of the cutting edge extends into the distal end and about half of the cutting edge extends outwardly from the distal end of the neck. The utility knife also includes a system for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the neck and the anchor opening to secure the blade in the neck.

In a further embodiment of the invention, I provide an improved utility knife. The utility knife includes a handle having a first end, a second end, and an elongate groove; a neck having a distal end, a proximate end, and an opening; an aperture formed in the distal end of the neck; and, a trapezoidal blade slidably inserted in the aperture. The blade includes a base; an upper edge opposed to and spaced apart from the base; a cutting edge extending along the base; and, an anchor opening formed through the blade. The blade is moveable between two operative positions with respect to the aperture, a first operative position with the blade slidably removed from the aperture, and a second inserted operative position with the blade slidably inserted in the aperture such that the anchor opening is in registration with the opening in the neck. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the opening in the neck and the anchor opening when the blade is in the second inserted operative position to secure the blade in the neck.

In another embodiment of the invention, I provide an improved utility knife. The knife includes a handle having a first end, a second end, and an elongate groove; a neck having a distal end, a proximate end, and an aperture formed in the distal end of the neck; and, a trapezoidal blade slidably inserted in the aperture and including a base, an upper edge opposed to and spaced apart from the base, a cutting edge extending along the base, and an anchor opening formed through the blade. The blade is moveable between two operative positions with respect to the aperture, a first operative position with the blade slidably removed from the aperture, and a second inserted operative position with the blade slidably inserted in the aperture. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes apparatus extending through the anchor opening when the blade is in the second inserted operative position to secure said blade in the neck. The utility knife also includes a slot formed in the neck for removing the blade from the aperture.

In still a further embodiment of the invention, I provide a utility knife including a handle having a first end, a second end, and an elongate groove; a neck having a distal end and a proximate end; a trapezoidal blade mounted on the distal end and including a base, an upper edge opposed to and spaced apart from the base, a cutting edge extending along the base, and an anchor opening formed through the blade. The utility knife also includes apparatus for pivotally attaching the proximate end to the first end such that the neck can be moved between two operative positions, a first open unfolded operative position with the cutting edge exposed for use to cut an object, and a second closed folded position with the cutting edge positioned in the groove. The utility knife also includes securing apparatus extending through the neck and the anchor opening to secure the blade in the neck. The blade, neck, and securing apparatus are shaped and dimensioned such that when the neck is in either of the first and second operative positions, the securing apparatus is inside of the handle.

In yet another embodiment of the invention, I provide an improved method of utilizing a utility knife. The utility knife includes a handle; a neck; and a trapezoidal blade mounted in the handle. The improved method includes the steps of pivotally attaching the neck to the handle such that the neck can be folded between an open and a closed position; pivoting the neck to a closed position; transporting the utility knife to a work location; and, pivoting the neck to an open position.

In a further embodiment of the invention, I provide an improved utility knife. The knife includes a handle having a first end and a second end; a neck having a distal end and having a proximate end; and, a trapezoidal blade mounted on the distal end. The blade includes a base; an upper edge opposed to and spaced apart from the base, and a cutting edge extending along at least a portion of the base. A portion of the blade extends into the distal end and another portion of the blade extends outwardly from the distal end of the neck. The utility knife also includes apparatus for pivotally attaching the proximate end to the first end such that the neck can be moved between two positions, a first open unfolded position with the cutting edge exposed for use to cut an object, and a second closed folded position with the cutting edge positioned adjacent the handle. The knife also includes an anchor apparatus to releasably secure the blade in the neck.

In another embodiment of the invention, I provide an improved utility knife. The knife includes a handle having a first end and a second end; a neck having a distal end; a proximate end; and, a longitudinal axis; an aperture formed in the distal end of the neck; and, a trapezoidal blade slidably inserted in the aperture. The blade includes a base; an upper edge opposed to and spaced apart from the base; and, at least one cutting edge on at least a portion of the base. The blade is moveable between two positions with respect to the aperture, a first position with the blade slidably removed from the aperture, and a second inserted position with a portion of the blade slidably inserted in the aperture and with the blade generally parallel to the longitudinal axis. The knife also includes apparatus for attaching the proximate end to the first end; and, apparatus for releasably securing the blade in the second position in the aperture.

In still a further embodiment of the invention, I provide an improved utility knife. The knife includes a handle having a first end and a second end; a neck having a distal end, a proximate end, a top, and a bottom; and, a trapezoidal blade mounted on the distal end. The blade includes a base; an upper edge opposed to and spaced apart from the base, and, at least one cutting edge extending along at least a portion of the base. A portion of the blade extends into the distal end of the neck and another portion of the blade extends outwardly from the distal end of the neck. The utility knife also includes apparatus for pivotally attaching the proximate end to the first end such that the neck can be moved between two positions, a first open unfolded position with the cutting edge exposed for use to cut an object, and a second closed folded position with the cutting edge positioned adjacent the handle. The utility knife also includes anchor apparatus to releasably secure the blade in the neck; and, a finger stop on the bottom adjacent the blade.

In still another embodiment of the invention, I provide an improved utility knife. The utility knife includes a handle having a first end, a second end, and a clip; a neck having a distal end and having a proximate end; and, a trapezoidal blade mounted on the distal end. The blade includes a base; an upper edge opposed to and spaced apart from the base; and, at least one cutting edge extending along at least a portion of the base. A portion of the blade extends into the distal end and another portion of the blade extends outwardly from the distal end of the neck. The utility knife also includes apparatus for pivotally attaching the proximate end to the first end such that the neck can be moved between two positions, a first open unfolded position with the cutting edge exposed for use to cut an object, and a second closed folded position with the cutting edge positioned adjacent the handle. The utility knife also includes anchor apparatus to releasably secure the blade in the neck.

In yet a further embodiment of the invention, I provide an improved method for cutting a piece of material. The method includes the step of providing a utility knife. The utility knife includes a handle having a first end and a second end; a neck having a distal end and having a proximate end; and, a trapezoidal blade mounted on the distal end. The blade includes a base; an upper edge opposed to and spaced apart from the base; a cutting edge extending along at least a portion of the base; and, apparatus for pivotally attaching the proximate end of the neck to the first end of the handle such that the neck can be moved between two positions, a first open unfolded position with the cutting edge exposed for use to cut an object, and a second closed folded position with the cutting edge positioned adjacent the handle. The neck is in the second position. The knife also includes apparatus to secure releasably the blade in the neck. The method also includes the steps of moving the neck to the first open unfolded position; and, cutting the material with the cutting edge of the trapezoidal blade.

In yet still another embodiment of the invention, I provide an improved method for providing a fresh edge for cutting a piece of material. The method includes the step of providing a utility knife. The utility knife includes a handle having a first end and a second end; a neck having a distal end, a proximate end, and a longitudinal axis; an aperture formed in the distal end of the neck; and, a trapezoidal blade slidably inserted in the aperture. The blade includes a base; an upper edge opposed to and spaced apart from the base, and at least one used cutting edge on said base. The blade is moveable between two positions with respect to the aperture, a first position with the blade slidably removed from the aperture in a direction of travel generally parallel to the longitudinal axis, and a second inserted position with a portion of the blade slidably inserted in the aperture in a direction of travel generally parallel to the longitudinal axis and with the blade generally parallel to said longitudinal axis. The utility knife also includes apparatus for attaching the proximate end to the first end such that the neck can be moved between two positions, a first open unfolded position with the cutting edge exposed for use to cut an object, and a second closed folded position with the cutting edge positioned adjacent the handle; and, securing apparatus for removably anchoring the blade in the second position in the aperture, the securing apparatus being positioned outside the handle when the neck is in the second position. The method also includes the steps of manipulating, while the neck is in the second closed folded position, the securing apparatus to release the blade such that the blade can be slidably removed from the aperture; slidably removing the blade from the aperture in a direction of travel generally parallel to the longitudinal axis; and, slidably inserting a blade with a fresh cutting edge in the aperture in a direction of travel generally parallel to the longitudinal axis.

In yet still a further embodiment of the invention, I provide an improved utility knife. The utility knife includes a handle having a first end and a second end; a neck having a distal end and a proximate end; and, a trapezoidal blade mounted on the distal end. The blade includes a base, an upper edge opposed to and spaced apart from the base, and at least one cutting edge extending along at least a portion of the base. A portion of the blade extends into the distal end and another portion of the blade extends outwardly from the distal end of the neck. The utility knife also includes apparatus for pivotally attaching the proximate end to the first end such that the neck can be moved between two operative positions, a first open unfolded position with the cutting edge exposed for use to cut an object, and a second closed folded position with the cutting edge positioned in the groove. The utility knife also includes anchor apparatus to releasably secure the blade in the neck; and, a spring displaceable to bear against a portion of the neck when the neck is in the first open position to maintain the neck in the first open position.

In a further embodiment of the invention, I provide an improved utility knife. The knife includes a handle having a first end, and a second end; a neck having a distal end and having a proximate end; and, a trapezoidal blade mounted on the distal end. The blade includes a base; an upper edge opposed to and spaced apart from the base; a cutting edge extending along the base; and, an anchor opening formed through the blade. A portion of the cutting edge extends into the distal end and a portion of the cutting edge extends outwardly from the distal end of the neck. The knife also includes a fastener pivotally attaching the proximate end to the first end such that the neck can be moved between two positions, a first open unfolded operative position with the cutting edge exposed for use to cut an object, and a second closed folded position with the cutting edge stored; and, a locking mechanism movable between at least two operative positions, a first operative position with a portion of the locking mechanism extending into the anchor opening to secure the blade in the neck, and a second operative position with the locking mechanism disengaged from the anchor opening to permit the blade to be removed from the neck.

In another embodiment of the invention, I provide an improved utility knife. The knife includes a handle having a first end and a second end; a neck having a distal end and having a proximate end and a cutting edge between the proximate end and the distal end; and, a trapezoidal blade mounted on the distal end. The blade includes a base; an upper edge opposed to and spaced apart from the base; a cutting edge extending along the base; and, an anchor opening formed through the blade. A portion of the cutting edge extends into the distal end and a portion of the cutting edge extends outwardly from the distal end of the neck. The knife also includes a fastener pivotally attaching the proximate end to the first end such that the neck can be moved between two positions, a first open unfolded operative position with the cutting edge exposed for use to cut an object, and a second closed folded position with the cutting edge stored; and, includes a locking mechanism for securing the blade in the neck.

Figure 5:
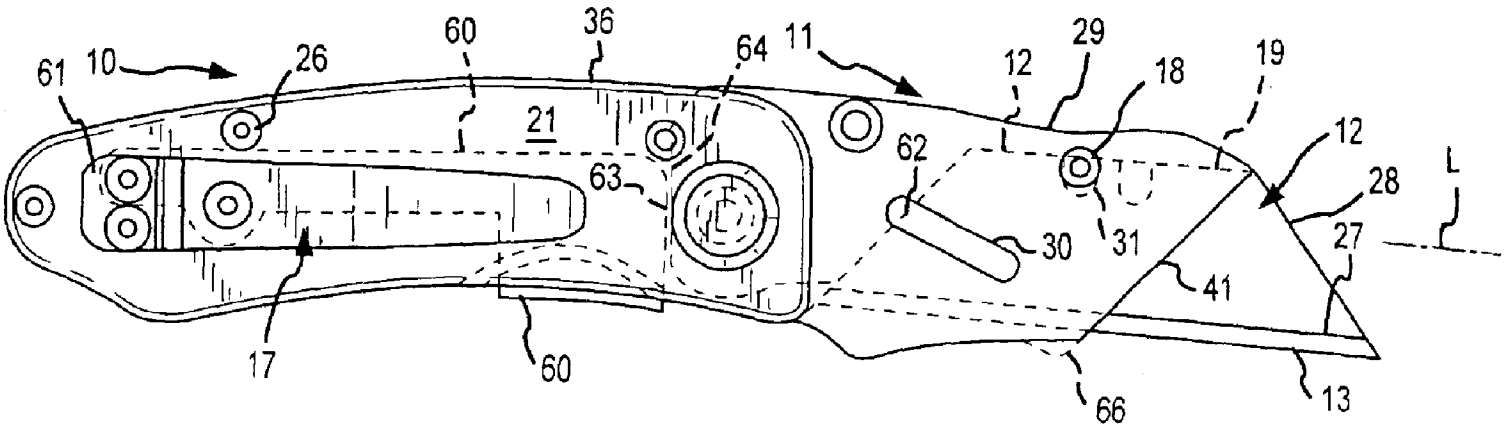
FIG. 5 is a side view of the exemplary utility knife of FIG. 4 illustrating additional construction details thereof.
Figure 6:
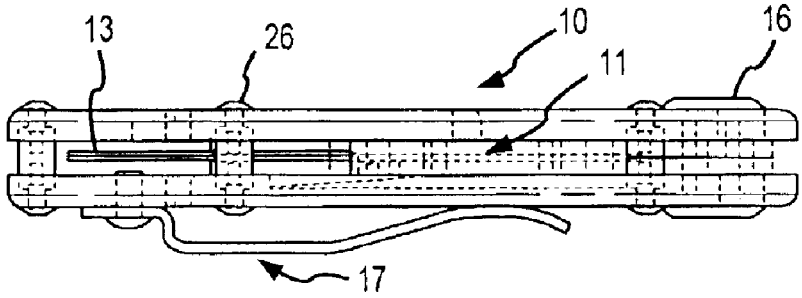
FIG. 6 is a duplication of the depiction of the exemplary utility knife of FIG. 2 with dashed lines incorporated to further illustrate construction details of the invention.
Figure 7:
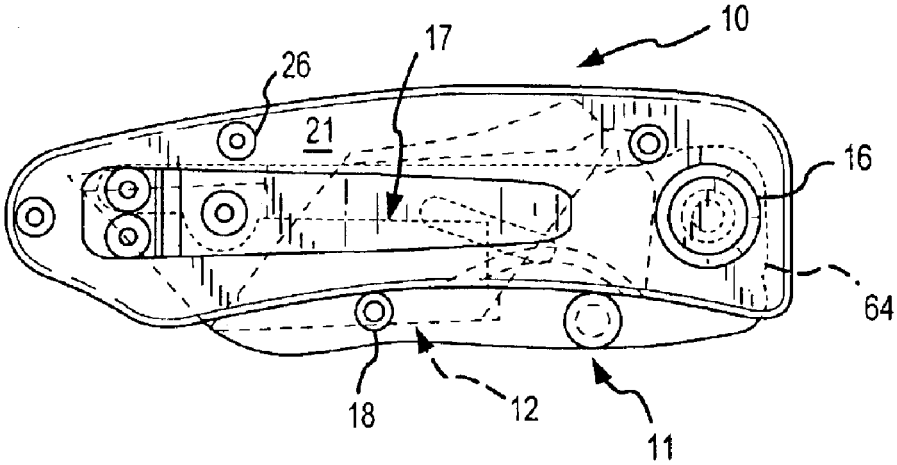
FIG. 7 is a duplication of the depiction of the exemplary utility knife of FIG. 3 with dashed lines incorporated to further illustrate construction details thereof.

Turning now to the drawings, which depict the presently exemplary embodiments of the invention for the purpose of illustrating the practice thereof and not by way of limitation of the scope of the invention, and in which like reference characters refer to corresponding elements throughout the several views, FIGS. 1 to 7 illustrate a utility knife including a handle 10 and neck 11. Handle 10 includes first end 50, second end 51, and groove 54. Neck 11 includes distal end 52, proximate end 53, tip or leading edge 38, and upper edge 29. Opening 15 is formed through neck 11. Opposing, spaced apart, slots 14 (FIG. 1) and 30 (FIG. 5) can be used to assist in removing blade 12 from neck 11 in the direction of arrow Z. Blade 12 includes leading edge 28 and trailing edge 62. Neck 11 includes aperture 39 shaped and dimensioned to slidably receive trapezoidal blade 12 such that an anchor opening 31 formed in blade 12 moves into registration with opening 15. When openings 15, 30 are in registration, bolt/nut 18 is passed through openings 15, 30 to removably fixedly secure blade 13 in aperture 39 and, consequently, in neck 11. Aperture 39 is bounded on one side by edge 40 (FIG. 1) and on the other side by edge 41 (FIG. 5). A pin or other desired fastening means can be used in place of bolt/nut 18. By way of example, and not limitation, if blade 12 is about 0.038 inch wide, then aperture 39 is typically from 0.039 to 0.048 inch wide.

Trapezoidal blade 12 includes base 27 (FIG. 5), upper edge 19 (FIG. 5), and anchor opening 31. The shape and dimension of upper edge 19 can vary as desired. Cutting edge 13 extends along base 27. When blade 12 is mounted in neck 11 in the manner shown in FIGS. 1 to 7, about one-half of cutting edge 13 (i.e., 40% to 60% of the length of edge 13) extends outwardly away from aperture 39 and neck 11 and can be utilized to cut an object. The other half of edge 13 is housed in aperture 39 in neck 11 such that the other half of edge 13 cannot be utilized for cutting. The proportion of blade 12 housed in neck 11 and unavailable for cutting can vary as desired.

The proximate end 53 of neck 11 is pivotally attached to the first end 50 of handle 10 by pin apparatus 16 or by any other desired fastening apparatus which permits neck 11 to pivot with respect to handle 10. Vertically oriented axis extends through pin apparatus 16.

Handle 10 includes sides 20 and 21. Side 20 includes upper edge 35. Side 21 includes upper edge 36. Clip 17 (FIGS. 2 and 3) is attached to side 21. Clip 17 permits the utility knife of the invention to be secured to a shirt pocket, belt, etc. Sides 20 and 21 are secured together by a plurality of bolts which each pass through an aperture in side 20 or 21 and thread into internally threaded hollow spacers. For example, in FIGS. 1 to 3, externally threaded bolts 26 thread into hollow, internally threaded spacer 25.

In use, neck 11 is pivotally attached to handle 10 with pin apparatus 16. Bolt/nut 18 is removed from opening 15. Trapezoidal blade 12 is slidably inserted in aperture 39 in the direction of arrow Y in FIG. 1 until opening 15 is in registration with opening 31. Aperture 39 and blade 12 are preferably, but not necessarily, shaped and dimensioned such that when blade 12 seats in aperture 39, openings 15 and 31 are in alignment. Bolt/nut 18 is inserted through aligned openings 15, 31 to removably fixedly secure blade 12 in aperture 39 and neck 11. Neck 11 is pivoted in the direction of arrow A to the folded operative position illustrated in FIGS. 2, 3, 6, 7. In the folded operative position, edge 13 is housed in groove 54. Groove 54 extends between sides 20 and 21 of handle 10. Spring 60 functions in the manner of a spring found in conventional pocket knives and functions to maintain neck 11 either in the folded operative position of FIGS. 2 and 3 or in the open or deployed operative position of FIGS. 1, 4, and 5.

Figure 2:
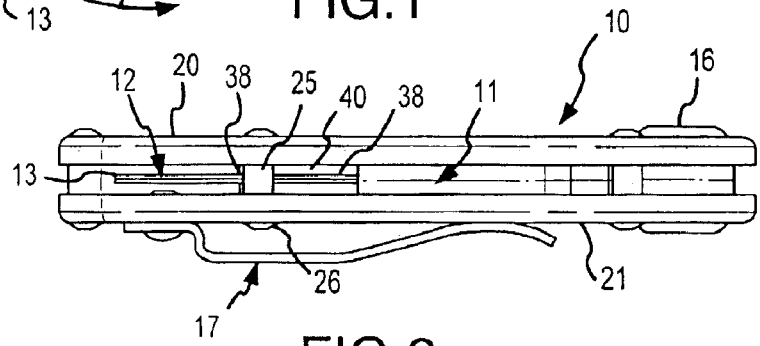
FIG. 2 is a bottom view of the exemplary utility knife of FIG. 1 illustrating the knife after the neck has been pivoted from the open position of FIG. 1 to a closed position.
Figure 3:
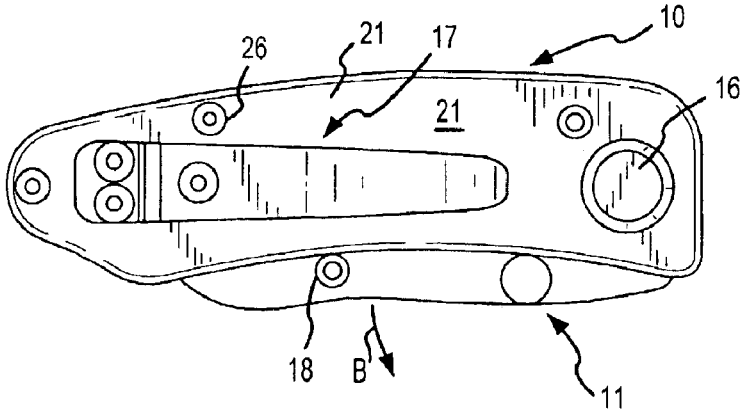
FIG. 3 is a side view of the exemplary utility knife of FIG. 2 illustrating further construction details thereof.
Figure 4:
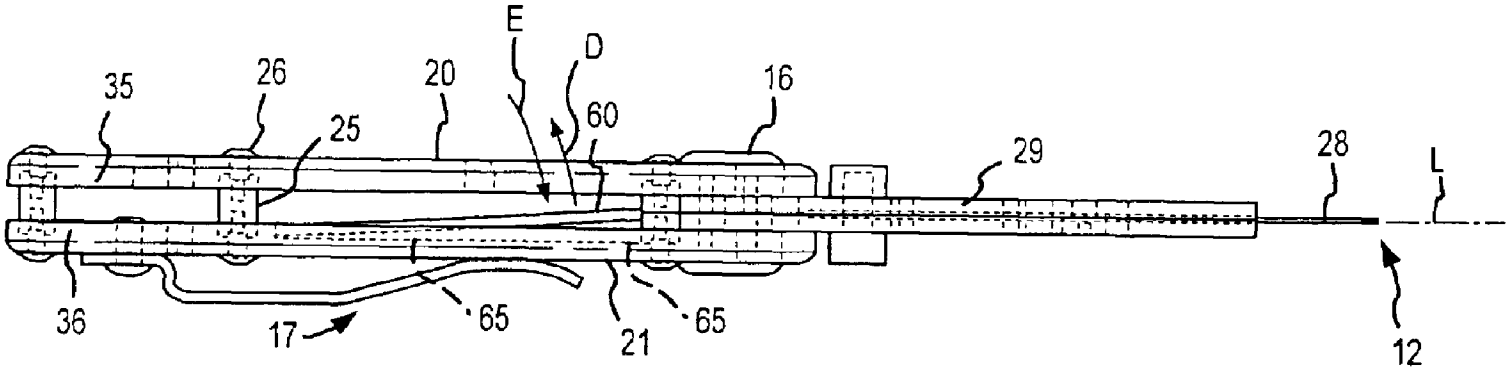
FIG. 4 is a top view of the exemplary utility knife of FIG. 1 illustrating the knife after it has been rotated about 180 degrees about axis X.

After the utility knife is in the folded operative position of FIG. 2, it is transported to a desired location at which the portion of neck 11 extending outwardly from handle 10 in FIG. 3 is grasped between the fingers of one hand and pulled outwardly in the direction of arrow B and pulled to the open operative position illustrated in FIG. 1. The handle 10 is then grasped, and the utility knife can be manipulated such that edge 13 cuts a desired object. In the event it is desired to remove blade 12, nut/bolt assembly 18 is removed and the nose of a screwdriver or other object is inserted into slot(s) 14, 30 against edge 62 (FIG. 5) of blade 12. The nose of the screwdriver is pushed or pulled in the direction of arrow C along slot(s) 14, 40 to push blade 12 out of aperture 39. A new blade 12 is inserted in the manner earlier described, or, the old blade is turned 180 degrees to expose the unused portion of edge 13 and is reinserted in aperture 39. Assembly 18 can be positioned inside or outside of groove 54 when neck 11 is in the closed position of FIG. 3.

Figure 8:
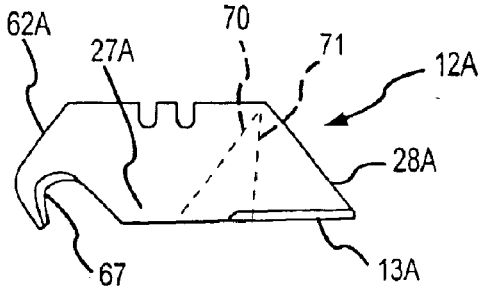
FIG. 8 is a front elevation view of another exemplary trapezoidal blade used in the utility knife of the invention.

FIG. 8 illustrates another trapezoidal blade 12A which can be utilized in the practice of the invention. Blade 12A includes base 27A and cutting edges 13A and 67. Hook-shaped cutting edge 67 extends along a portion of base 27A. Straight cutting edge 13A extends along a portion of base 27A.

Figure 9:
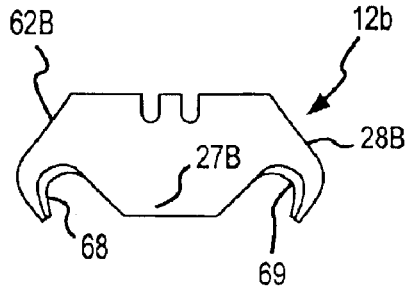
FIG. 9 is a front elevation view of another exemplary trapezoidal blade used in the utility knife of the invention.

FIG. 9 illustrates still another trapezoidal blade 12B that can be utilized in the practice of the invention. Blade 12B includes base 27B and cutting edges 67 and 68. Hook-shaped cutting edge 68 extends along a portion of base 27B. Hook-shaped cutting edge 69 extends along a portion of base 27B. It is understood that the trapezoidal shape of a blade 12, 12A, 12B can vary as desired as long as the blade provide at least one cutting edge which can be utilized in the manner illustrated in FIGS. 1 to 9, 10. For example, if the triangular portion of blade 12A to the right of dashed line 70 in FIG. 8 is cut off blade 12A, the remaining portion of blade 12A still has a trapezoidal shape. Or, if the triangular portion of blade 12A to the right of dashed line 71 in FIG. 8 is cut off blade 12A, the remaining portion of blade 12A is deemed to have a trapezoidal shape.

Figure 10:
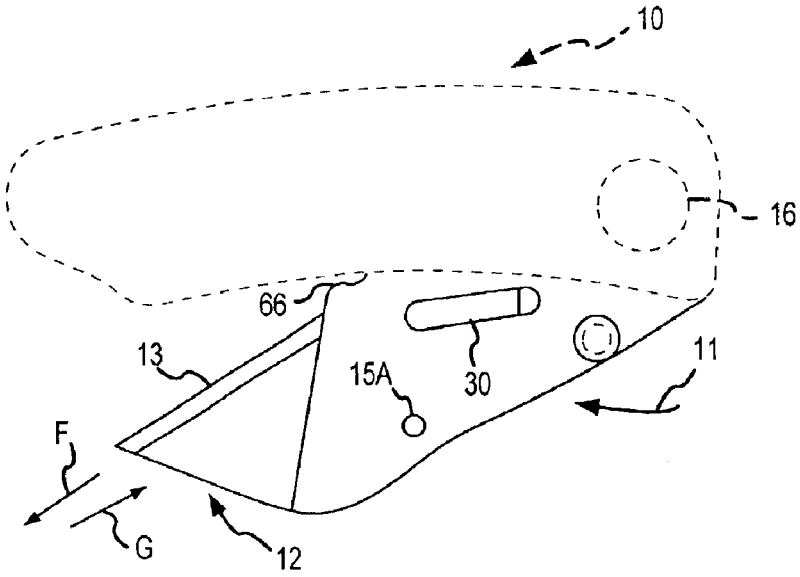
FIG. 10 is a front view illustrating the exemplary insertion in the utility knife of the invention a trapezoidal blade having a fresh cutting edge.

FIG. 10 illustrates how a blade 12 is removed from and inserted in the utility knife of the invention. When the utility knife is in the orientation illustrated in FIG. 3, an Allen wrench, pliers, or a user's fingers can be utilized to remove bolt 18. This is particularly advantageous because bolt 18 is positioned outside of handle 10 so that it can be removed without requiring neck 11 to be moved to an open position which would expose cutting edge 13. Bolt 18 extends through apertures 15 and 15A in neck 11 and through aperture 31 (FIG. 5) in blade 12. Once bolt 18 is removed, blade 12 is grasped and pulled outwardly in the direction of travel indicated by arrow F. The direction of travel indicated by arrow F is parallel to the longitudinal axis L (FIGS. 4, 5) of neck 11. Blade 12 normally is removed when it is damaged or when cutting edge 13 is dull.

Before blade 12 can be removed, neck 11 is slightly opened in the manner illustrated in FIG. 10 so that there is room to pull blade 12 free from neck 11 without blade 12 contacting handle 11. Neck 11 is slightly opened by pivoting neck 11 from the closed position shown in FIGS. 2, 3, 6, 7 through an angle of less than ninety degrees.

A replacement blade with a fresh cutting edge is obtained. A fresh cutting edge can be obtained by obtaining a brand new blade, or, in the event only half of the cutting edge 13 of blade 12 has been used, by rotating the blade 12 one hundred and eighty degrees to expose the unused portion of edge 13 that was housed inside neck 11 while the exposed portion of edge 13 of blade 12 was used.

Once a replacement blade with a fresh cutting edge 13 is obtained, it is slid into aperture 39 in the direction of travel indicated by arrow G to the position which was occupied by blade 12 before blade 12 was removed. The direction of travel indicated by arrow G is generally parallel to the longitudinal axis L of neck 11. A direction of travel is generally parallel to the longitudinal axis L if the angle between axis L and the direction of travel is ten degrees or less.

For sake of this example, it is assumed that the shape and dimension of the replacement blade is equal to that of blade 12. A replacement blade could, however, be some other trapezoidal blade, for instance, the blades in FIGS. 8 and 9.

After a replacement blade is slidably inserted in neck 11 to the position illustrated in FIG. 10, bolt 18 is installed through apertures 15, 15A and through aperture 31 of the replacement blade to releasably secure the replacement blade on neck 11.

The above-described procedure for replacing a blade 12 in neck 11 is particularly safe because cutting edge 13 is either housed in handle 11 or is close to handle 11 (as shown in FIG. 10) while blade 12 is being released and slidably pulled from neck 11.

Figure 11:
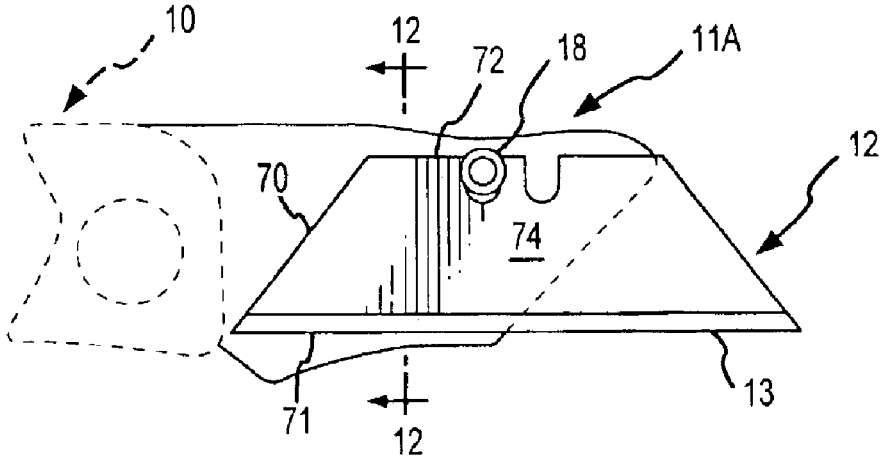
FIG. 11 is a front elevation view illustrating an alternate embodiment of the invention.
Figure 12:
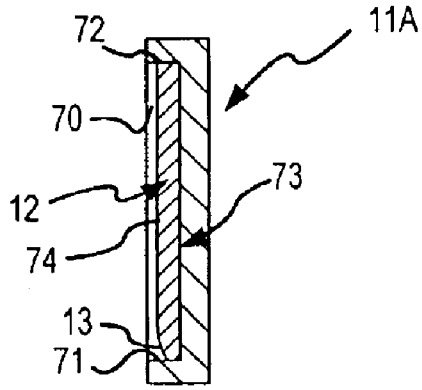
FIG. 12 is a side sectional view of the exemplary utility knife of FIG. 11.

In FIGS. 1 to 7, 10, when a blade 12 is mounted on neck 11, the portion of blade 12 in aperture 39 is fully bounded on both sides by neck 11. If desired, however, blade 12 can be mounted on neck 11 such that blade 12 is not fully bounded on both sides by neck 11. For example, in FIGS. 11 and 12, neck 11A is configured such that blade 12 is only bounded on one side by neck 11A. A detent or aperture 73 is formed in neck 11A such that one side or face 74 of blade 12 is fully exposed. Detent 73 includes edges 72, 70, and 71 which bound and contact the portion of blade 12 mounted on neck 11A. Although blade 12 can be slid into detent 73, blade 12 can also be mounted on neck 11A by placing an end of blade 12 in registration with detent 73 and by then simply dropping or pushing that end of blade 12 into detent 73, after which a bolt 18 or other means is used to secure releasably blade 12 on neck 11A.

A finger stop 66 is formed on the bottom of neck 11 adjacent cutting edge 13 and blade 12. The finger stop helps to prevent a user from sliding his index finger along the bottom of neck 11 onto cutting edge 13.

The invention also includes a system and method for removably or permanently securing blade 12 into the neck which includes the need for minimal or no tools. The system and method for securing the blade may include any component which is suitably configured to restrict blade 12 from movement out of the neck. One embodiment of the invention is illustrated in FIGS. 13 to 18 and includes neck 11A and handle 10A. Blade 12 slides into and out of neck 11A in the same manner that blade 12 slides into and out of neck 11 and that is described above. Neck 11A includes an aperture which is, like aperture 39 in neck 11, shaped and dimensioned to slidably receive trapezoidal blade 12. FIGS. 13 to 18 illustrate the position of blade 12 in neck 11A after blade 12 is inserted therein.

The lower portion of neck 11A is provided with serrated cutting edge 78. A straight cutting edge or cutting edge of any other desired shape and dimension can be formed on the lower portion of neck 11A instead of serrated cutting edge 78. Edge 78 can be used alone or in conjunction with the edge 13 of a blade 12 inserted in neck 11A.

Figure 17:
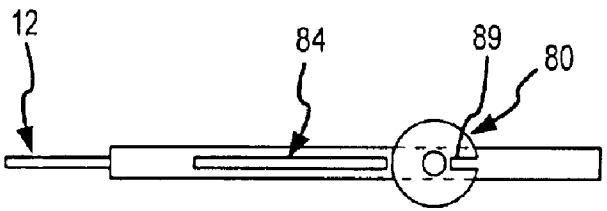
FIG. 17 is a top view of the knife neck of FIGS. 13 and 14 further illustrating the exemplary mode of operation thereof.
Figure 18:
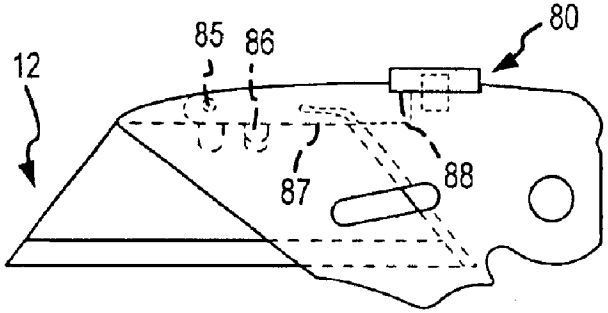
FIG. 18 is a side elevation view of the knife neck of FIG. 17 illustrating the exemplary mode of operation thereof.
Figure 15:
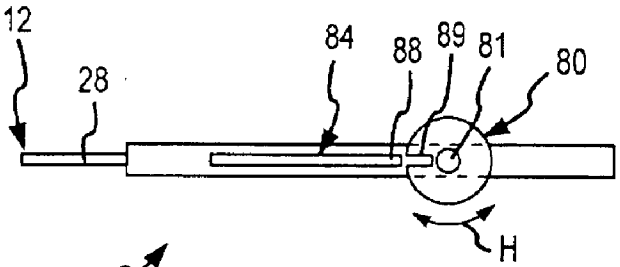
FIG. 15 is a top view of the knife neck of FIGS. 13 and 14 illustrating the exemplary mode of operation thereof.
Figure 16:
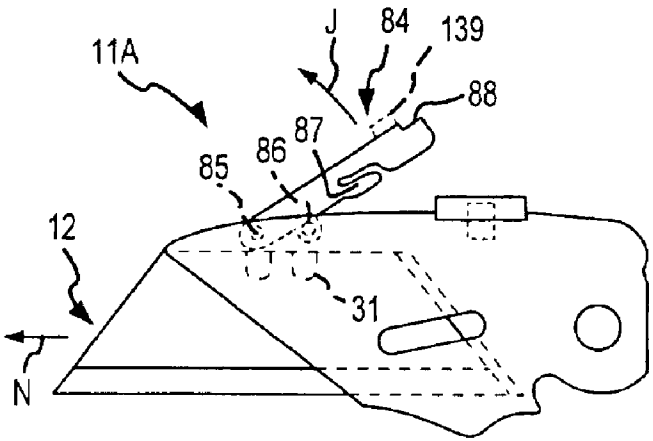
FIG. 16 is a side elevation view of the knife neck of FIG. 15 illustrating further exemplary construction details thereof.

Blade 12 is secured in neck 11A by lever arm 84. In FIGS. 14, 17, 18 arm 84 is in the closed position and nub 86 extends into anchor opening 31 to prevent blade from being slidably removed from neck 11A in the direction of arrow N (FIG. 16). Arm 84 is maintained in the closed position of FIGS. 14, 17, 18 by cylindrical knob 80. Knob 80 can be rotated on fixed pin 81 in the directions indicated by arrows H in FIG. 15. A slot 89 is formed through knob 80 and, as will be described, is shaped and dimensioned to permit the distal end of arm 84 to pass through slot 89. Arm 84 is pivotally secured to neck 11A by pin 85. Spring member 87 functions to push against the top edge 19 of blade 12 and to generate a force acting to displace arm 84 upwardly in the direction of arrow J. In order to move arm 84 to the open position illustrated in FIGS. 15 and 16, knob 80 is rotated from the position illustrated in FIGS. 14, 17, 18 to the position illustrated in FIGS. 15 and 16. In FIGS. 15 and 16, slot 89 has been moved into alignment and registration with the distal end 88 of arm 84 such that spring member 87 upwardly displaces the distal end 88 of arm 84 through slot 89 to the position illustrated in FIGS. 15 and 16. When arm 84 is in the position shown in FIGS. 15 and 16, nub 86 is moved to a position outside of notch 31 and nob 86 therefore no longer secures blade 12 in neck 11A. If desired, blade 12 can then be slidably removed from neck 11A in the direction of arrow N.

A small nub or handle 139 can be attached to arm 84 (FIG. 16). A user grasps handle 139 and pulls upwardly in the direction of arrow J to pull arm 84 out of neck 11A in the direction of arrow J. Similarly, a U-shaped opening 82 (FIG. 14) can be formed through neck 11A so that a user can grasp a portion of arm 84 and lift arm 84 upwardly in the direction of arrow J—much like a pocket knife is opened by grasping and pulling the portion of the top edge of a blade in the pocket knife.

In FIG. 16, arm 84 can be returned to the position illustrated in FIGS. 13, 14, 17, 18 by pressing arm 84 downwardly in a direction opposite that indicated by arrow J. After arm 84 is pressed downwardly to the position shown in FIGS. 13, 14, 17, 18, arm 84 is maintained in position by turning knob 80 in the direction of arrows H to move slot 89 out of registration with the distal end 88 such that distal end 88 presses upwardly against the bottom of knob 80 and is prevented from moving in the direction of arrow J.

The embodiment of the invention illustrated in FIGS. 13 to 18 uses a pivoting arm 84 that can be moved between a first operative locking position (FIG. 14) and a second operative release position (FIG. 16). The embodiments of the invention illustrated in FIGS. 19 to 24 and explained below also utilized locking—release mechanisms that move between a first operative locking position and a second operative released position. It is also possible to use an arm or pin 151 (FIG. 23) that simply slides (and does not pivot) in an opening 150 formed in neck 11A between (1) a first locking position in which a portion of the sliding arm engages notch 31A or another portion of blade 12 to lock a blade 12 in position in neck 11A, and (2) a second release position in which the arm does not engage notch 31A and lock blade 12 in position.

Figure 20:
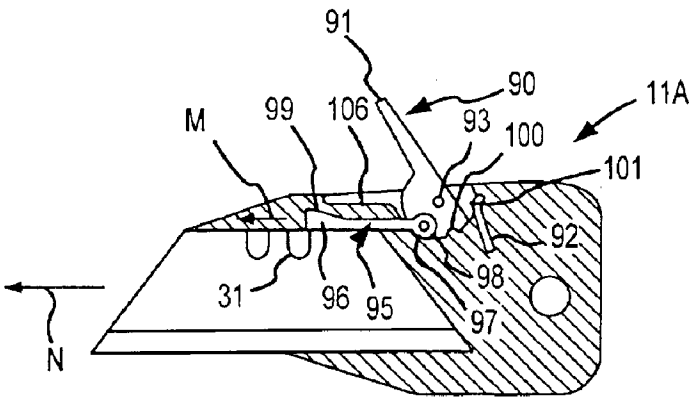
FIG. 20 is a side elevation view of an exemplary utility knife neck of FIG. 19 illustrating the mode of operation thereof.
Figure 19:
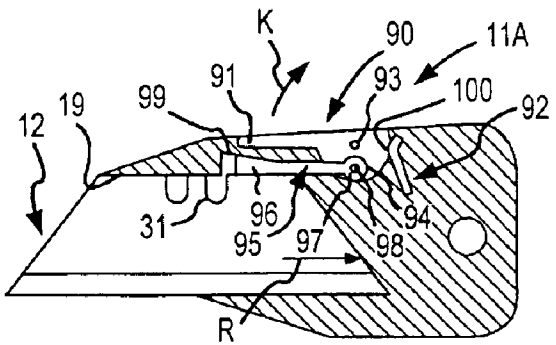
FIG. 19 is a side elevation view illustrating an exemplary utility knife neck constructed in accordance with another embodiment of the invention.

The embodiment of the invention illustrated in FIGS. 19 and 20 includes displaceable arms 90 and 95 and spring 92. Arm 90 pivots on fixed pin 93. Pin 93 is fixedly connected to neck 11. End 97 of arm 95 pivots about fixed pin 98. Pin 98 extends into groove 94. Groove 94 extends through arm 95. FIG. 19 illustrates arms 90 and 95 in the closed locking position. In FIG. 19, arm 95 is pulled in the direction of arrow R such that the enlarged cam end 96 is wedged against canted surface 99 and the top edge 19 of blade 12. When end 96 is wedged against surface 99 and top edge 19, end 96 prevent blade 12 from moving. Spring 92 bears against detent 100 to help maintain arm 90 in the position shown in FIG. 19.

FIG. 20 illustrates arms 90 and 95 after arm 90 is displaced in the direction of arrow K and, consequently, arms 90 and 95 are displaced from the closed locking position to the open release position. When end 91 of arm 90 is moved in the direction of arrow K (FIG. 19) to pivot arm 90 about pin 93, arm 95 is displaced in the direction of arrow M, releasing blade 12 such that blade 12 can, if desired, be removed from neck 11A in the direction of arrow N. Arm 90 seats in groove 106 when arm 90 is in the closed position illustrated in FIG. 19.

Figure 22:
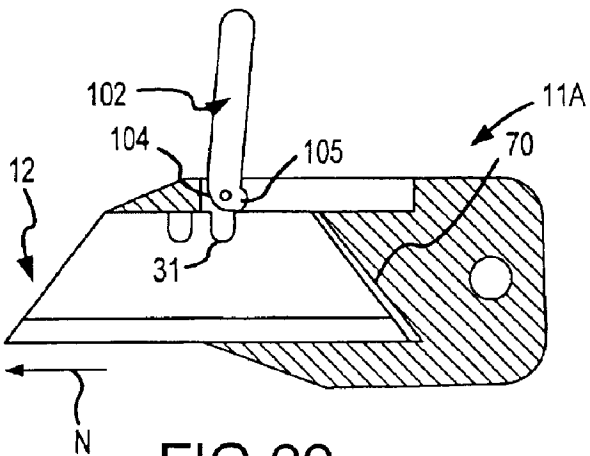
FIG. 22 is a side elevation view of an exemplary utility knife neck of FIG. 21 illustrating the mode of operation thereof.
Figure 21:
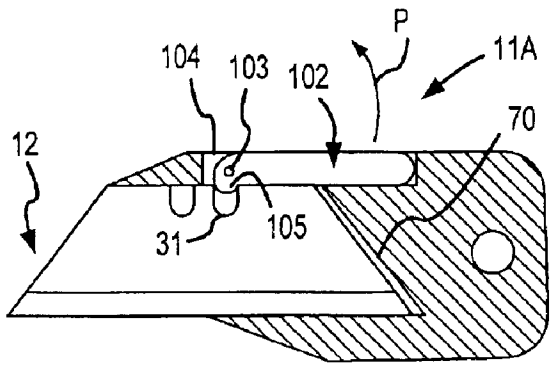
FIG. 21 is a side elevation view illustrating an exemplary utility knife neck constructed in accordance with still another embodiment of the invention.

The embodiment of the invention illustrated in FIGS. 21 and 22 includes displaceable arm 102. The proximate cam end 105 of arm 102 pivots about pin 103. Pin 103 is fixedly mounted in neck 11A. Arm 102 seats in elongate groove 104. FIG. 21 illustrates arm 102 in the closed locking position. In FIG. 21, cam end 105 extends into notch 31 and prevents blade 12 from moving.

FIG. 22 illustrates arm 102 after arm 102 is displaced upwardly in the direction of arrow P. In FIG. 22, cam end 105 has been moved out of notch 31 and, consequently, blade 12 can be slidably removed from neck 11A in the direction of arrow N.

Figure 24:
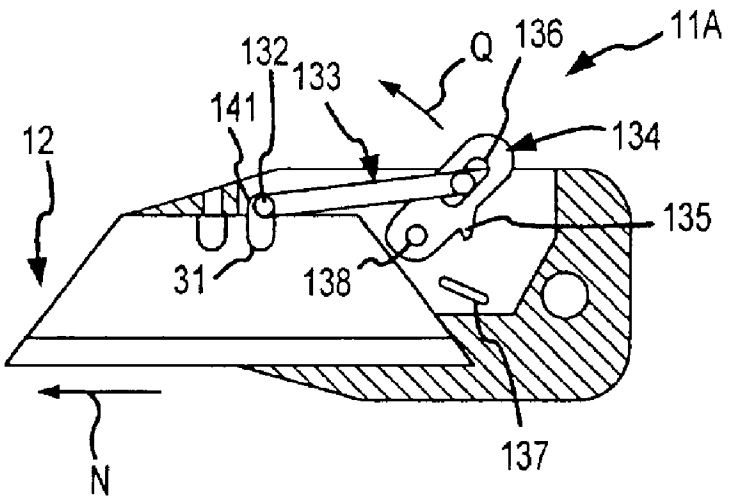
Figure 23:
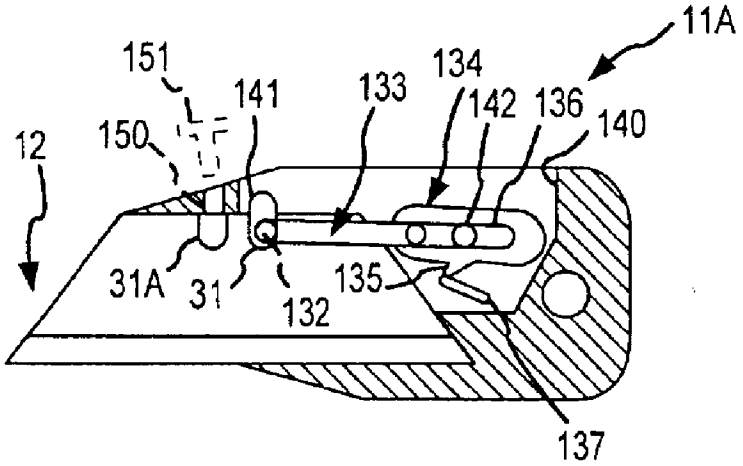
FIG. 23 is a side elevation view illustrating an exemplary utility knife neck constructed in accordance with yet a further embodiment of the invention; and, FIG. 24 is a side elevation view of an exemplary utility knife neck of FIG. 23 illustrating an exemplary mode of operation thereof.

The embodiment of the invention illustrated in FIGS. 23 and 24 includes displaceable arms 133 and 134 and spring 137. The distal end of arm 133 is connected fixedly to a pin 142 that slides and pivots in groove 136 formed through arm 134. The proximate end of arm 133 is connected fixedly to a pin 132 that slides and pivots in notch 31 and in groove 141. Groove 141 is formed in neck 11A and is in registration with notch 31 when blade 12 is inserted in neck 11A to the position shown in FIGS. 23 and 24. Arm 134 pivots on pin 138. Pin 138 is fixedly secured to end 11A.

When arms 133 and 134 are in the closed locked position illustrated in FIG. 23, pin 132 engages notch 31 and prevents blade 12 from being slidably removed from neck 11A in the direction of arrow N. When arm 134 is in the closed position depicted in FIG. 23, spring 137 presses against finger 135 of arm 134 and generates forces that act to move arm 134 in the direction of arrow Q. The forces generated by spring 137 are not sufficient to move arm 134 from the position of arm 134 in FIG. 23. However, spring 134 facilitates manually displacing arm 134 in the direction of arrow Q.

Displacing arm 134 in the direction of arrow Q moves arms 133 and 134 from the closed locking position of FIG. 23 to the open release position of FIG. 24. In FIG. 24, pin 132 has moved upwardly out of notch 31 into groove 141, arms 133 and 134 have pivoted and moved in the direction of arrow Q, and, consequently, blade 12 can be slidably removed from neck 11A in the direction of arrow N. Arms 133 and 134 and spring 137 are mounted in slot 140 formed in neck 11A.

In FIGS. 13 to 24, arms 84, 90, 95, 102, 133, 134, 151 each move in a plane that is parallel to the side or face 74 of a blade 12 in neck 11A. Arms 84, 90, 95, 102, 133, 134 151 each preferably move in a plane that is parallel to face 74 or is canted with respect to face 74 at an angle of forty-five degrees or less, preferably twenty degrees or less, and most preferably ten degrees or less.

Arms 84, 90, 95, 102, 133, 134, 151 each engage, or facilitate the engagement, of a notch 31, 31A formed in the top of blade 12. The notch engaged by said arms can, if desired, be formed in an portion of a blade 12.

Arms 84, 90, 95, 102, 133, 134, 151 are each mounted in neck 11A. It is possible to utilize an arm—linkage system in which part of the system is incorporated in a handle 10A, but such a system presently appears impractical and is not exemplary. Arms 84, 90, 95, 102, 133, 134, 151 are presently preferably, but not necessarily, generally positioned above a blade 12 and in the top or upper portion of arm 11A to facilitate the operation of said arms to lock and release blade 12.

In FIGS. 13 to 24 arms 84, 90, 95, 102, 133, 134, 151 are generally located in neck 11A above blade 12. These arms and other components of the locking mechanisms used to secure blade 12 in neck 11A can, if desired be located in neck 11A adjacent any desired portion or portions of blade 12, including the side(s), back, or bottom of blade 12.

In FIG. 13, internally threaded opening 160 is formed through one side of neck 11A, in the same manner that opening 14A is formed through one side of neck 11A. Set screw 161 (FIG. 14) turns into opening 160. The inner end 162 of set screw 161 bears against face 74A of blade 12 to maintain blade 12 in neck 11A. Blade 12 is slidably removed from neck 11A once set screw 161 is loosened such that end 162 does not bear against face 74A.

The construction of neck 11A can vary as desired as long as blade 12 can be mounted thereon and neck 11A can be folded between open and closed positions with respect to handle 10A.

In the foregoing specification, the invention has been described with reference to specific embodiments. However, it will be appreciated that various modifications and changes can be made without departing from the scope of the present invention. The specification and figures are to be regarded in an illustrative manner, rather than a restrictive one, and all such modifications are intended to be included within the scope of present invention. Benefits, other advantages, and solutions to problems have been described above with regard to specific embodiments. No element described herein is required for the practice of the invention unless expressly described as "essential" or "critical".

What is claimed is:

1. A utility knife including (a) a handle having a first end, and a second end;

(b) a neck having a distal end and having a proximate end;

(c) a blade mounted on said distal end, said blade including (i) a base, (ii) an upper edge opposed to and spaced apart from said base, (iii) a cutting edge extending along said base, and (d) a fastener pivotally attaching said proximate end to said first end such that said neck can be moved between two positions, (i) a first open unfolded operative position with said cutting edge exposed for use to cut an object, and (ii) a second closed folded position with said cutting edge stored adjacent said handle; and, (e) a locking mechanism movable between at least two operative positions, (i) a first operative position with a portion of said locking mechanism securing said blade in said neck, and (ii) a second operative position with said locking mechanism disengaged to permit said blade to be removed from said neck, wherein said locking mechanism further includes a knob to maintain said locking mechanism in said first operative position.

2. The utility knife of claim 1, wherein said knob is configured to rotate to release said locking mechanism into said second operative position.

3. The utility knife of claim 1, wherein said locking mechanism further includes a lever arm, said knob includes a slot wherein said slot is configured to allow said lever arm to release such that said locking mechanism is in said second operative position.

4. The utility knife of claim 1, wherein said locking mechanism further includes a lever arm, said knob includes a slot, said knob configured to be rotated to move said slot in and out of registration with said lever arm to allow said locking mechanism to move between said at least two operative positions.

5. The utility knife of claim 1, wherein said locking mechanism further includes a lever arm having a nub extending into an anchor opening in said blade, wherein said knob is configured to release said lever arm and remove said nub from said anchor opening in said blade.

6. A utility knife including (a) a handle having a first end, and a second end;

(b) a neck having a distal end and having a proximate end;

(c) a blade mounted on said distal end, said blade including (i) a base, (ii) an upper edge opposed to and spaced apart from said base, (iii) a cutting edge extending along said base, and (d) a fastener pivotally attaching said proximate end to said first end such that said neck can be moved between two positions, (i) a first open unfolded operative position with said cutting edge exposed for use to cut an object, and (ii) a second closed folded position with said cutting edge stored adjacent said handle; and, (e) a locking mechanism movable between at least two operative positions, (i) a first operative position with a portion of said locking mechanism securing said blade in said neck, and (ii) a second operative position with said locking mechanism disengaged to permit said blade to be removed from said neck, wherein said locking mechanism further includes a lever arm having a pivot end and a distal end, wherein said distal end of said lever arm includes a spring, said spring configured to exert a force against said distal end of said lever arm.

7. A utility knife including (a) a handle having a first end, and a second end;

(b) a neck having a distal end and having a proximate end;

(c) a blade mounted on said distal end, said blade including (i) a base, (ii) an upper edge opposed to and spaced apart from said base, (iii) a cutting edge extending along said base, and (d) a fastener pivotally attaching said proximate end to said first end such that said neck can be moved between two positions, (i) a first open unfolded operative position with said cutting edge exposed for use to cut an object, and (ii) a second closed folded position with said cutting edge stored adjacent said handle; and, (e) a locking mechanism movable between at least two operative positions, (i) a first operative position with a portion of said locking mechanism securing said blade in said neck, and (ii) a second operative position with said locking mechanism disengaged to permit said blade to be removed from said neck, wherein said locking mechanism includes a nub extending into an anchor opening in said blade, said nub configured to restrict said blade from disassociation with said neck.

8. A utility knife including (a) a handle having a first end, and a second end;

(b) a neck having a distal end and having a proximate end;

(c) a blade mounted on said distal end, said blade including (i) a base, (ii) an upper edge opposed to and spaced apart from said base, (iii) a cutting edge extending along said base, and wherein said blade further includes an anchor opening formed through said blade, a portion of said cutting edge extending into said distal end and a portion of said cutting edge extending outwardly from said distal end of said neck, (d) a fastener pivotally attaching said proximate end to said first end such that said neck can be moved between two positions, (i) a first open unfolded operative position with said cutting edge exposed for use to cut an object, and (ii) a second closed folded position with said cutting edge stored adjacent said handle; and, (e) a locking mechanism movable between at least two operative positions, when the neck is at the open unfolded operative position;

(i) a first operative position with a portion of said locking mechanism securing said blade in said neck, and (ii) a second operative position with said locking mechanism disengaged to permit said blade to be removed from said neck.

* * * * *